US009295143B1

(12) United States Patent
Xiong et al.

(10) Patent No.: US 9,295,143 B1
(45) Date of Patent: Mar. 22, 2016

(54) WIRELESS CONTROLLED LIGHTING SYSTEM WITH SHARED SIGNAL PATH ON OUTPUT WIRES

(71) Applicant: Universal Lighting Technologies, Inc., Madison, AL (US)

(72) Inventors: Wei Xiong, Madison, AL (US); Travis L. Berry, Madison, AL (US); Keith Davis, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 9 days.

(21) Appl. No.: 14/471,263

(22) Filed: Aug. 28, 2014

Related U.S. Application Data

(60) Provisional application No. 61/899,792, filed on Nov. 4, 2013.

(51) Int. Cl.
*H05B 37/02* (2006.01)
*H05B 33/08* (2006.01)
*H05B 41/282* (2006.01)

(52) U.S. Cl.
CPC ..... *H05B 37/0272* (2013.01); *H05B 33/0815* (2013.01); *H05B 41/2827* (2013.01)

(58) Field of Classification Search
USPC ..... 315/247, 224, 225, 185 S, 291, 315/307–326, 274–280
See application file for complete search history.

(56) References Cited

U.S. PATENT DOCUMENTS 8,076,920 B1 * 12/2011 Melanson ..... H02M 1/4208 315/247
2005/0179404 A1 * 8/2005 Veskovic ..... H05B 37/0254 315/291
2010/0327766 A1 * 12/2010 Recker ..... H02J 9/02 315/291
2014/0217886 A1 * 8/2014 Knoedgen ..... H05B 33/0848 315/51

* cited by examiner

*Primary Examiner* — Tuyet Vo
(74) *Attorney, Agent, or Firm* — Patterson Intellectual Property Law, P.C.; Mark J. Patterson; Gary L. Montle

(57) ABSTRACT

A lighting system includes circuitry to provide wireless LED driver or fluorescent ballast control without requiring changes to existing wiring setups. A power stage includes a power converter coupled across a first set of power terminals. The first power terminals are coupled to a second set of terminals via the wiring. A load stage is coupled to the second power terminals, wherein power provided across the first set of terminals is received by the load stage and deliverable to lighting devices. The load stage further includes a dimming control signal receiver coupled across the second set of power terminals and configured to receive an encoded dimming control signal. The encoded signal is transmitted across the wiring setup, wherein the power stage further includes a dimming control signal decoder coupled across the first set of power terminals and effective to deliver a decoded dimming control signal to the controller.

20 Claims, 1 Drawing Sheet

WIRELESS CONTROLLED LIGHTING SYSTEM WITH SHARED SIGNAL PATH ON OUTPUT WIRES

CROSS-REFERENCES TO RELATED APPLICATIONS

This application claims benefit of U.S. Provisional Patent Application No. 61/899,792, filed Nov. 4, 2013, and which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF THE INVENTION

The present invention relates generally to dimmable lighting control systems. More particularly, the present invention relates to wireless controlled lighting systems having a shared signal path on output wires between a power stage and a load stage.

Light dimming is an effective way to achieve energy saving or energy management. Several popular dimming methods existing in the lighting market include but are not necessarily limited to: 0-10V analog dimming, step dimming, power line control, and DALI ("Digital Addressable Lighting Interface") control. Each of these dimming methods require additional wiring for implementation of the respective control signals. This additional wiring makes retrofitting less attractive because wiring changes must be made to accommodate the dimming function.

Wireless control is very desirable, at least in part because the relevant control signals do not need any physical wiring configuration in order to reach the control unit. However, fluorescent ballasts or LED drivers are typically enclosed in a metal can, and are typically further enclosed in a metal lighting fixture. The respective metal housings may typically act like a signal shield that renders wireless communication impractical, if not nearly impossible.

For the purpose of making wireless lighting control practical, it would therefore be desirable that retrofitting such a control scheme would not require changes to existing LED driver or fluorescent lamp ballast wiring.

It would further be desirable that the wireless lighting control be implemented in such a way that the wireless signal receiving may be highly reliable.

Referring to FIG. 1, a wiring diagram as represented therein demonstrates a conventional configuration for a lighting system 10 including a fluorescent ballast or LED driver 12. As shown therein, a typical driver or ballast design includes an input of Vac mains 14 and two or more output leads 16 for providing power across a wiring arrangement 18 to input leads 20 associated with the load 22.

It would therefore be further desirable in view of such conventional configurations to use the output leads as a dimming/control signal feedback path to the ballast or driver, wherein no extra wiring or other wiring modifications would be needed to the ballast/driver in order to realize the dimming control function.

BRIEF SUMMARY OF THE INVENTION

Lighting systems and methods as disclosed herein will effectively solve the aforementioned existing problems for wireless lighting control, and further make the solution attractive in a practical sense.

In summary, the proposed wireless control technology minimizes wiring changes and simplifies the driver/receiver design for practical wireless control practice in a lighting system.

In an embodiment, a lighting system as disclosed herein includes circuitry to provide wireless control of an LED driver or fluorescent ballast without requiring changes to existing wiring setups. A power stage includes a power converter coupled across a first set of power terminals. The first power terminals are coupled to a second set of terminals via the wiring. A load stage is coupled to the second power terminals, wherein power provided across the first set of terminals is received by the load stage and deliverable to lighting devices. The load stage further includes a dimming control signal receiver coupled across the second set of power terminals and configured to receive an encoded dimming control signal. The encoded signal is transmitted across the wiring setup, wherein the power stage further includes a dimming control signal decoder coupled across the first set of power terminals and effective to deliver a decoded dimming control signal to the controller.

In one aspect, the controller provides control signals to the power converter whereby power delivered by the power converter is regulated in response to the decoded dimming control signal. The power stage may include a fluorescent lighting ballast for providing an AC power output for driving one or more fluorescent lamps. Alternatively, the power stage may include an LED driver effective to provide a DC power output for driving one or more light-emitting diodes.

In another aspect, the encoded dimming control signal is delivered from the load stage to the decoder in the power stage via the first and second sets of power terminals.

In another aspect, the load stage may include a dimming control circuit module coupled between the second set of power terminals and a third set of power terminals configured to receive the one or more lighting devices, the dimming control circuit module comprising the dimming signal receiver. Alternatively, the load stage may include an integrated lighting unit having the dimming signal receiver and one or more lighting devices coupled in parallel across the second set of power terminals.

In another aspect, the dimming signal receiver may include a wireless signal receiver and a galvanic isolation circuit coupled between the wireless signal receiver and the second set of power terminals.

In another aspect, the galvanic isolation circuit may include a signal transformer, wherein a primary side of the signal transformer is coupled across first and second outputs of the wireless signal receiver, and a secondary side of the signal transformer is coupled across the second set of power terminals.

DETAILED DESCRIPTION OF THE INVENTION

Figure 1:
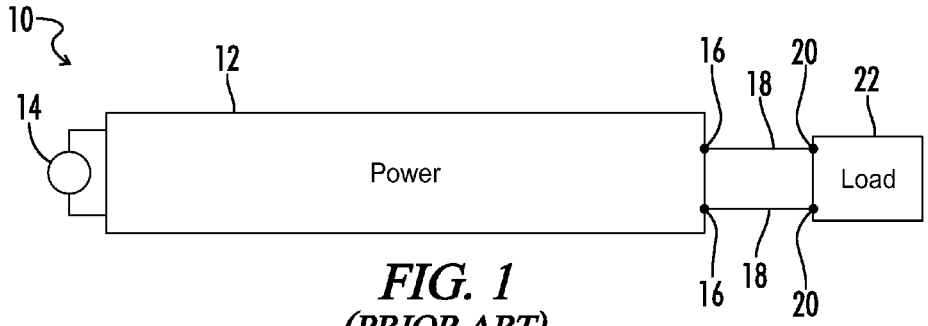
FIG. 1 (PRIOR ART)
FIG. 1 is a block diagram representing a wiring arrangement for a lighting system as conventionally known in the art.

Throughout the specification and claims, the following terms take at least the meanings explicitly associated herein, unless the context dictates otherwise. The meanings identified below do not necessarily limit the terms, but merely provide illustrative examples for the terms.

The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices.

The term "circuit" means at least either a single component or a multiplicity of components, either active and/or passive, that are coupled together to provide a desired function.

The term "signal" as used herein may include any meanings as may be understood by those of ordinary skill in the art, including at least an electric or magnetic representation of current, voltage, charge, temperature, data or a state of one or more memory locations as expressed on one or more transmission mediums, and generally capable of being transmitted, received, stored, compared, combined or otherwise manipulated in any equivalent manner.

The terms "power converter" and "converter" unless otherwise defined with respect to a particular element may be used interchangeably herein and with reference to at least DC-DC, DC-AC, AC-DC, buck, buck-boost, boost, half-bridge, full-bridge, H-bridge or various other forms of power conversion or inversion as known to one of skill in the art.

Terms such as "providing," "processing," "supplying," "determining," "calculating" or the like may refer at least to an action of a computer system, computer program, signal processor, logic or alternative analog or digital electronic device that may be transformative of signals represented as physical quantities, whether automatically or manually initiated.

The terms "controller," "control circuit" and "control circuitry" as used herein may refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

Figure 2:
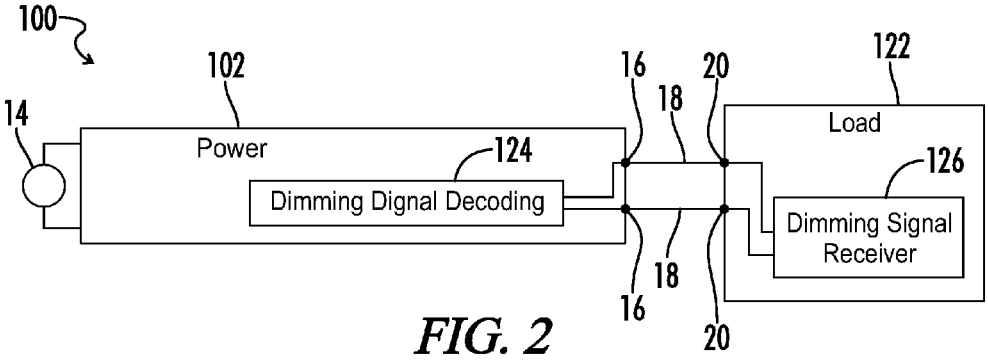
FIG. 2 is a block diagram representing a wiring arrangement according to an embodiment of a wireless controlled lighting system of the present invention.
Figure 3:
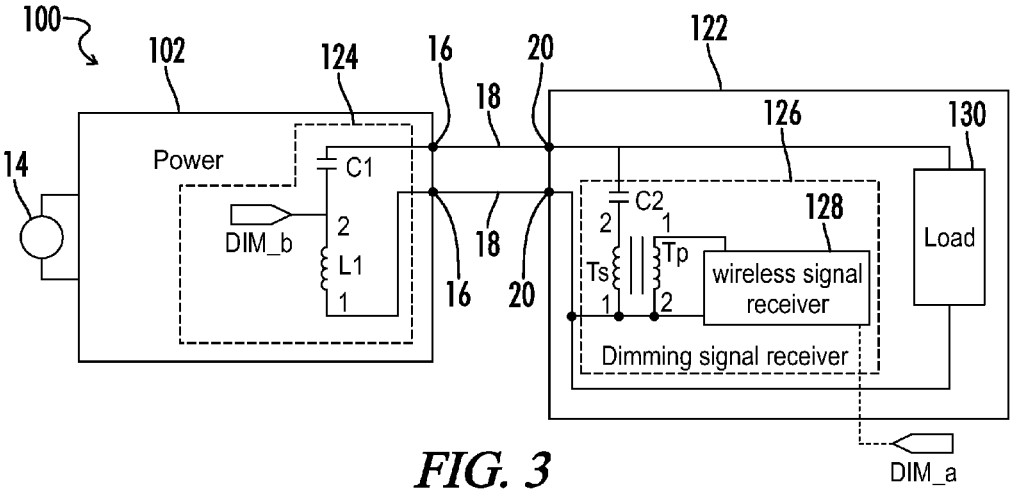
FIG. 3 is a circuit block diagram representing a more detailed wiring arrangement according to an embodiment of a wireless controlled lighting system of the present invention.

Referring generally to FIGS. 2-3, exemplary embodiments of a wireless controlled lighting system and method may now be described. Where the various figures may describe embodiments sharing various common elements and features with other embodiments, similar elements and features are given the same reference numerals and redundant description thereof may be omitted below.

Referring now more particularly to FIG. 2, in one embodiment of a lighting system 100 according to the present invention a dimming signal decoding circuit 124 may be added in association with a power stage 102 including a driver/ballast design to control the output. The power stage 102 may typically include a power converter and an associated controller, wherein power received from an input power source 14 is regulated and generated across power stage output terminals/leads 16.

A dimming signal receiver 126 is further connected between the input terminals/load stage leads 20 of a load stage 122 for wireless signal receiving. The received signal may then be fed back to the driver/ballast of the power stage 102 through leads 16, 20. One of skill in the art may appreciate that no extra wire 18 needs to be added to the system to practice such an embodiment. The dimming signal receiver 126 needs only to be connected to the leads 16, 20 to realize and implement wireless control capabilities.

Referring further to FIG. 3, in an embodiment the dimming signal receiver 126 can be connected between load stage leads 20 to realize and facilitate dimming control. In the dimming signal receiver 126 as demonstrated there is a wireless signal receiver 128 that will pick up a coded wireless signal from a remote transmitter (not shown). Those of skill in the art may appreciate that the coded wireless signal may be in any number of forms representative of a desired dimming level, and that a user may typically enter the desired dimming level into an interface associated with the remote transmitter, wherein a coded wireless signal is generated and then transmitted to the wireless receiver 128.

An isolation circuit may further be provided between the wireless receiver 128 and the remainder of the circuitry and components associated with the load stage 122. In the embodiment shown in FIG. 3, galvanic isolation may be provided wherein the primary side Tp of a signal transformer is connected to the wireless signal receiver to feed back the control signal DIM_a to the load stage leads 20 via the secondary side Ts of the signal transformer and capacitor C2.

In the power stage 102 a dimming signal decoder circuit 124 may include a capacitor C1 and inductor L1 coupled in series and further connected in parallel across the power stage output leads 16. The inductor L1 will pick up the coded signal fed back by the signal transformer Ts/Tp. The dimming/control signal DIM_b across L1 can be further processed by the driver/ballast to control the output. One of skill in the art may further appreciate that while the controller and associated circuitry and processes for generating an AC output from a lighting ballast to a load that includes one or more fluorescent lamps may be structurally distinguishable from the circuitry and processes for generating a DC output from an LED driver to a load including one or more light-emitting elements, the scope of the invention as previously described may consistently be applied to either exemplary application. In other words, a controller and associated circuitry associated with either of a ballast or LED driver may adequately regulate an output power to the load based on the decoded dimming signal as provided according to the present disclosure and without requiring further modification or explanation.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A lighting system comprising:

first and second sets of power terminals;

a power stage comprising a power converter configured to provide power across the first set of power terminals, and a controller configured to regulate the power provided by the power converter;

a load stage coupled to the second set of power terminals, wherein the power provided across the first set of power terminals is received by the load stage and deliverable to a load comprising one or more lighting devices;

the load stage further comprising a dimming control signal receiver coupled across the second set of power terminals and configured to receive an encoded dimming control signal; and the power stage further comprising a dimming control signal decoder coupled across the first set of power terminals, and effective to deliver a decoded dimming control signal to the controller.

2. The lighting system of claim 1, wherein the controller is effective to regulate power delivered by the power converter in response to the decoded dimming control signal.

3. The lighting system of claim 2, wherein the encoded dimming control signal is delivered from the load stage to the decoder in the power stage via the first and second sets of power terminals.

4. The lighting system of claim 3, the power stage comprising a lighting ballast effective to provide an AC power output for driving a load comprising one or more fluorescent lamps.

5. The lighting system of claim 3, the power stage comprising an LED driver effective to provide a DC power output for driving a load comprising one or more light-emitting diodes.

6. The lighting system of claim 3, the load stage comprising a dimming control circuit module coupled between the second set of power terminals and a third set of power terminals configured to receive the one or more lighting devices, the dimming control circuit module comprising the dimming signal receiver.

7. The lighting system of claim 6, the dimming signal receiver comprising a wireless signal receiver and a galvanic isolation circuit coupled between the wireless signal receiver and the second set of power terminals.

8. The lighting system of claim 7, the galvanic isolation circuit comprising a signal transformer, a primary side of the signal transformer coupled across first and second outputs of the wireless signal receiver, a secondary side of the signal transformer coupled across the second set of power terminals.

9. The lighting system of claim 3, the load stage comprising an integrated lighting unit having the dimming signal receiver and one or more lighting devices coupled in parallel across the second set of power terminals.

10. The lighting system of claim 9, the dimming signal receiver comprising a wireless signal receiver and a galvanic isolation circuit coupled between the wireless signal receiver and the second set of power terminals.

11. The lighting system of claim 10, the galvanic isolation circuit comprising a signal transformer, a primary side of the signal transformer coupled across first and second outputs of the wireless signal receiver, a secondary side of the signal transformer coupled across the second set of power terminals.

12. A lighting fixture comprising:

a housing having an input effective to receive an AC power source and an output effective to receive a load comprising one or more lighting devices;

first and second sets of power terminals;

a power stage disposed within the housing and comprising a power converter configured to convert power from the AC power source into a power output across the first set of power terminals, and a controller configured to regulate the power output from the power converter;

a wiring configuration coupled between the first set of power terminals and the second set of power terminals;

a load stage coupled to the second set of power terminals, wherein the output power from the power converter is deliverable to the load;

the load stage further comprising a dimming control signal receiver coupled across the second set of power terminals and configured to receive an encoded dimming control signal; and the power stage further comprising a dimming control signal decoder coupled across the first set of power terminals, and effective to deliver a decoded dimming control signal to the controller.

13. The lighting fixture of claim 12, the controller effective to regulate power delivered by the power converter in response to the decoded dimming control signal.

14. The lighting fixture of claim 13, wherein the encoded dimming control signal is delivered from the load stage to the decoder in the power stage via the wiring configuration.

15. The lighting system of claim 14, the power stage comprising a lighting ballast effective to provide an AC power output for driving a load comprising one or more fluorescent lamps.

16. The lighting system of claim 14, the power stage comprising an LED driver effective to provide a DC power output for driving a load comprising one or more light-emitting diodes.

17. The lighting system of claim 14, the load stage comprising an integrated lighting unit having the dimming signal receiver and one or more lighting devices coupled in parallel across the second set of power terminals.

18. The lighting system of claim 17, the dimming signal receiver comprising a wireless signal receiver and a galvanic isolation circuit coupled between the wireless signal receiver and the second set of power terminals.

19. The lighting system of claim 18, the galvanic isolation circuit comprising a signal transformer, a primary side of the signal transformer coupled across first and second outputs of the wireless signal receiver, a secondary side of the signal transformer coupled across the second set of power terminals.

20. A method of providing wireless dimming control in a lighting system, the method comprising:

receiving an encoded wireless dimming control signal in an isolated receiver circuit associated with a load stage for the lighting system;

transmitting the encoded control signal across a first set of power terminals to a decoder associated with a power stage for the lighting system;

decoding the encoded dimming control signal;

generating a power output for a load comprising one or more lighting devices based on a level of the decoded dimming control signal; and transmitting the power output for the load across the first set of power terminals and to the load stage.

* * * * *